US007424869B2

(12) United States Patent
Haase

(10) Patent No.: US 7,424,869 B2
(45) Date of Patent: Sep. 16, 2008

(54) COOLING CIRCUIT FOR AN INTERNAL COMBUSTION ENGINE

(75) Inventor: Reiko Haase, Ebersbach (DE)

(73) Assignee: Daimler AG, Stuttgart (DE)

( * ) Notice: Subject to any disclaimer, the term of this patent is extended or adjusted under 35 U.S.C. 154(b) by 0 days.

(21) Appl. No.: 11/899,396

(22) Filed: Sep. 5, 2007

(65) Prior Publication Data

US 2008/0035080 A1 Feb. 14, 2008

Related U.S. Application Data

(63) Continuation-in-part of application No. PCT/EP2006/001630, filed on Feb. 23, 2006.

(30) Foreign Application Priority Data

Mar. 5, 2005 (DE) ..... 10 2005 010 236

(51) Int. Cl.
*F01P 7/14* (2006.01)

(52) U.S. Cl. ..... 123/41.1; 123/41.44; 123/41.54

(58) Field of Classification Search ..... 123/41.1, 123/41.44, 41.01, 41.54
See application file for complete search history.

(56) References Cited

U.S. PATENT DOCUMENTS

| | | | | |
|---|---|---|---|---|
| 4,273,081 | A | 6/1981 | Cleveland et al. | |
| 4,300,718 | A | 11/1981 | Beyer | |
| 4,643,134 | A | 2/1987 | Schnizlein | |
| 5,095,855 | A * | 3/1992 | Fukuda et al. | 123/41.44 |
| 6,109,218 | A | 8/2000 | Bachschmid et al. | |
| 7,243,620 | B2 * | 7/2007 | Takahashi | 123/41.1 |
| 2002/0023596 | A1 | 2/2002 | Hirano et al. | |
| 2004/0107922 | A1 * | 6/2004 | Roth | 123/41.1 |

FOREIGN PATENT DOCUMENTS

| | | |
|---|---|---|
| DE | 32 16 062 | 2/1983 |
| DE | 39 40 825 | 6/1991 |
| DE | 40 41 937 | 7/1991 |
| DE | 39 28 477 | 3/1994 |
| DE | 43 42 292 | 6/1995 |
| EP | 1 108 508 | 2/1984 |
| JP | 02 248 614 | 10/1990 |
| JP | 02 248614 | 10/1990 |
| JP | 2000230425 | 8/2000 |

* cited by examiner

*Primary Examiner*—Stephen K. Cronin
*Assistant Examiner*—Sizo B Vilakazi
(74) *Attorney, Agent, or Firm*—Klaus J. Bach

(57) ABSTRACT

In a cooling circuit for an internal combustion engine of a motor vehicle including a pump device arranged upstream of the internal combustion engine, a cooler having an inlet side connected to a coolant outlet of the internal combustion engine and an outlet connected via a coolant line to the inlet side of the pump device, a cooler bypass line extending from the outlet side of the internal combustion engine to the inlet side of the pump device while bypassing the cooler and a switching valve arranged in the coolant line between the cooler and the pump device, a switching valve bypass duct is provided bypassing the switching valve and including a valve device which is open when the engine is shut down for reliable ventilation of the second coolant line during filling of the cooling circuit.

4 Claims, 1 Drawing Sheet

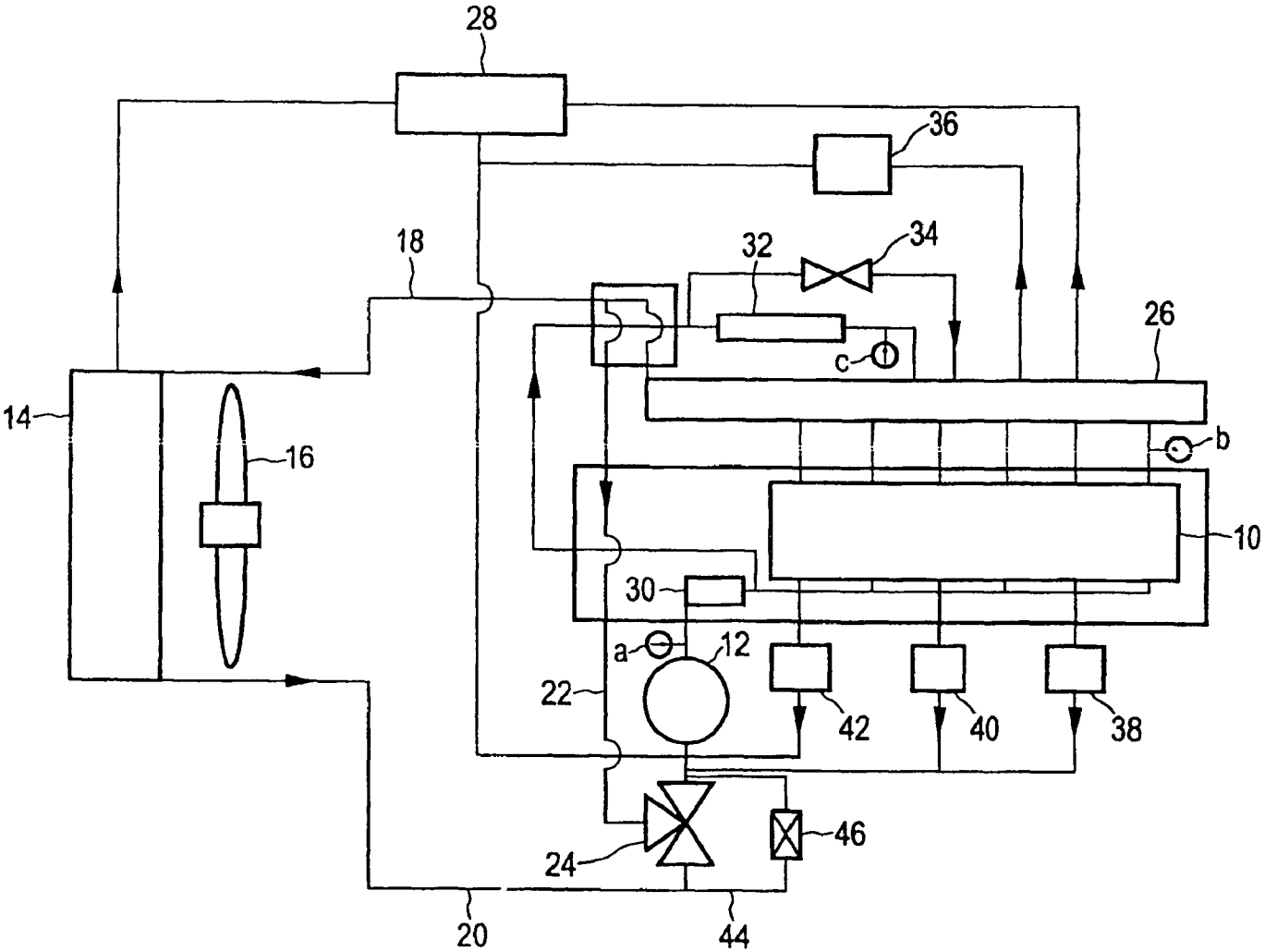
Fig.

COOLING CIRCUIT FOR AN INTERNAL COMBUSTION ENGINE

This is a Continuation-In-Part Application of pending International Patent Application PCT/EP2006/001630 filed Feb. 23, 2006 and claiming the priority of German Patent Application 10 2005 010 236.0 filed Mar. 5, 2006.

BACKGROUND OF THE INVENTION

The invention relates to a cooling circuit for an internal combustion engine of a motor vehicle including a coolant pump arranged upstream of the engine, a cooler whose inlet is connected to the engine and whose outlet is connected to the pump and a cooler bypass line extending from the engine coolant outlet directly to the coolant pump by-passing the cooler.

Cooling circuits for internal combustion engines are already known in a variety of embodiments. In addition to ensuring the actual operation of a cooling circuit for cooling the internal combustion engine and further components of the motor vehicle and, if appropriate, the utilization of the heated coolant as a heat source for heating devices of an air-conditioning system of the motor vehicle, it is also important for the cooling circuit that it can be vented at various points or components when necessary.

An equalizing tank, for example, is generally provided which is connected inter alia to a venting duct of the cooler and on the one hand ensures a certain coolant quantity in the cooling circuit and on the other hand also provides a venting function. An arrangement of this type is described for example in DE 39 28 477 C2, wherein a turbo-charger is additionally arranged downstream of the internal combustion engine.

In addition, it is disclosed for example in DE 43 42 292 A1 to provide a collecting tank, which is arranged downstream of the internal combustion engine, with a filling line and also a venting line.

DE 39 40 825 C2 discloses a hydrodynamic flow retarder which includes integrated therein in a compact manner a heat exchanger and a collecting tank for the working fluid. The collecting tank is provided with a venting line which is merged with a venting line of the retarder.

In addition, U.S. Pat. Nos. 4,273,081, 4,300,718 and 4,643,134 disclose each a cooling circuit in which a thermostat valve is arranged between the internal combustion engine and the cooler which opens when the coolant temperature in the internal combustion engine exceeds a predetermined temperature. Provided parallel to the thermostat valve is in each case one venting line. In the case of U.S. Pat. No. 4,273,081, the ventilating line is provided with a valve arrangement which closes during the course of the filling process of the internal combustion engine in order to prevent an undesired discharge of the coolant out of the internal combustion engine to the cooler.

In the case of a coolant circuit as specified in the introduction for an internal combustion engine, it is additionally desirable to also be able to vent the coolant line between the cooler and the inlet or suction side of the pump device. In conventional cooling circuits, this is possible only in a complex manner by means of external venting lines and valves.

It is the object of the present invention to provide a simple and cost-effective possibility of ensuring reliable venting of the cooling line between the cooler and the inlet side of the pump device during the filling process of a cooling circuit for an internal combustion engine of the type specified in the introduction.

SUMMARY OF THE INVENTION

In a cooling circuit for an internal combustion engine of a motor vehicle including a pump device arranged upstream of the internal combustion engine, a cooler having an inlet side connected to a coolant outlet of the internal combustion engine and an outlet connected via a coolant line to the inlet side of the pump device, a cooler bypass line extending from the outlet side of the internal combustion engine to the inlet side of the pump device while bypassing the cooler and a switching valve arranged in the coolant line between the cooler and the pump device, a switching valve bypass duct is provided bypassing the switching valve and including a valve device which is open when the engine is shut down for reliable ventilation of the second coolant line during filling of the cooling circuit.

The coolant line between the cooler and the inlet or suction side of the pump device can be ventilated without complex structural measures and without problems by means of the switching valve bypass duct.

The valve device additionally arranged in the switching valve bypass duct is designed or can be activated so as to prevent a return flow of the coolant from the inlet side of the pump device into the second coolant line when the engine is running.

The valve device in the bypass duct may be designed so as to close when the differential pressure across the valve device exceeds a predetermined threshold value. Said predetermined threshold value is for example selected to be in a range between approximately 0.1 bar and approximately 0.3 bar.

The above features and advantages of the invention will become more readily apparent from the following description of a preferred exemplary embodiment of the invention with reference to the appended drawings.

BRIEF DESCRIPTION OF THE DRAWINGS

The sole FIGURE is a schematic illustration of a cooling circuit for an internal combustion engine of a motor vehicle as provided in a preferred exemplary embodiment of the invention.

DESCRIPTION OF A PREFERRED EMBODIMENT

The cooling circuit which is illustrated in the FIGURE serves for cooling an internal combustion engine 10 and other components of a motor vehicle.

The cooling circuit comprises a main circuit including the internal combustion engine 10, a pump device 12 which is arranged upstream of the internal combustion engine 10 for pumping a coolant, in particular cooling water, through the internal combustion engine 10, and a cooler 14 which is cooled by means of a fan 16. The coolant, for example cooling water, is circulated via a first coolant line 18 from the internal combustion engine 10 to the cooler 14 and via a second coolant line 20 from the cooler 14 to the pump device 12.

In order, for example in the event of a cold start of the internal combustion engine 10, to heat the latter as quickly as possible to its optimum operating temperature, a cooler bypass line 22 is also provided which connects the outlet side of the internal combustion engine 10 directly to the inlet side of the pump device 12 while bypassing the cooler 14. Arranged for example at the connecting point of the cooler bypass line 22 and the second coolant line 20 is a switching valve 24 in the form of a thermostatic valve which opens and closes as a function of the temperature, measured for example at the outlet side of the internal combustion engine 10, of the coolant (temperature sensor c). When the thermostatic valve 24 is closed, the cooler bypass line 22 is blocked, that is to say all of the coolant flows through the cooler 14 and is cooled in the latter before being supplied to the internal combustion engine. When the thermostatic valve 24 is open, in contrast, the cooler bypass line 22 is open, that is to say depending on the degree of opening of the thermostatic valve 24, at least a part of the coolant bypasses the cooler 14, so that the temperature of the coolant which is supplied to the internal combustion engine 10, which temperature results from a mixing of the coolant which is cooled by means of the cooler 14 and the coolant which bypasses the cooler 14, can be controlled corresponding to the degree of opening of the thermostatic valve 24.

In addition, the cooling circuit contains, in a known way, a collecting tank 26 downstream of the internal combustion engine 10, which collecting tank 26, like the cooler 14, is additionally connected to an equalizing tank 28. The collecting tank 26 and the compensating tank 28 serve conventional functions, which are therefore not described in any more detail here.

In addition, an oil cooler 30 is for example provided between the pump device 12 and the internal combustion engine 10, and the coolant supply line branches off upstream of the internal combustion engine 10 to an exhaust gas cooler 32 and an exhaust gas recirculation valve 34 whose outlet sides likewise open out into the collecting tank 26, as illustrated in the FIGURE.

As indicated in the FIGURE, the coolant which is heated in the internal combustion engine 10 can also be utilized as a heat source for a heater 36 of an air-conditioning system (not illustrated in any more detail) of the motor vehicle, by virtue of a part of the heated coolant being supplied from the collecting tank 26 to a heater 36.

The coolant supply line can also branch off upstream of the internal combustion engine 10 to an air compressor 38, a fuel cooler 40, a water filter 42 and the like whose outlet sides are guided back again to the inlet or suction side of the pump device 12.

In addition, temperature sensors a, b, c are provided at various points of the cooling circuit in order to measure the temperature of the coolant and to correspondingly control individual components of the cooling circuit.

In addition to the components illustrated in the FIGURE and specified above, the cooling circuit conventionally also contains various valve devices for controlling the coolant flow. It is additionally possible to integrate a retarder and/or an exhaust gas turbocharger into the illustrated cooling circuit.

The above design of the cooling circuit is already known to a person skilled in the art, for which reason extensive explanations of the mode of operation are not needed here. In addition, the cooling circuit can be modified with conventional measures which are known to a person skilled in the art in conventional cooling circuits.

The cooling circuit according to the present invention also contains a switching valve bypass duct 44 which connects the second coolant line 20 directly to the inlet side of the pump device 12 while bypassing the switching valve 24. Arranged in said switching valve bypass duct 44 is a valve device 46 which is designed or can be activated in such a way as to (a) prevent a return flow of the coolant from the inlet side of the pump device 12 into the second coolant line 20 at all times, (b) open a direct connection from the second coolant line 20 to the inlet side of the pump device 12 when the internal combustion engine 10 is at standstill and (c) close said direct connection when the differential pressure on both sides of the valve device exceeds a predetermined threshold value. Said predetermined threshold value is for example selected to be in a range between approximately 0.1 bar and approximately 0.3 bar.

By means of the switching valve bypass duct 44, it is possible in a simple manner to reliably vent the second coolant line 20 between the cooler and the thermostat valve 24 or the pump device 12 during the filling process. The valve device 46, which closes with pressure, then closes said switching valve bypass duct 44, after the engine is started, at a differential pressure of 0.1-0.3 bar. No external venting lines and valves are required for the venting process, so that the production costs of the cooling circuit can be kept low.

What is claimed is:

1. A cooling circuit for an internal combustion engine of a motor vehicle, the cooling circuit comprising:

the internal combustion engine (10) having a coolant inlet side and a coolant outlet side, a pump device (12) arranged upstream of the internal combustion engine (10) with an inlet and an outlet connected to the coolant inlet side of the internal combustion engine (10) for pumping a coolant through the internal combustion engine (10), a cooler (14) connected by means of a first coolant line (18) to the outlet side of the internal combustion engine (10) and by means of a second coolant line (20) to the inlet of the pump device (12), a cooler bypass line (22) extending between the outlet side of the internal combustion engine (10) and the inlet of the pump device (12) while bypassing the cooler (14); and a switching valve (24), arranged in the second coolant line (20) between the cooler (14) and the pump device (12) for selectively opening and closing the second coolant line (20), the cooler bypass line (22) being also connected to the switching valve (24) to be controlled thereby, switching valve bypass line (44) extending between the second coolant line (20) and the inlet of the pump device (12) while bypassing the switching valve (24) and a valve device (46) arranged in the switching valve bypass line (44), which valve device (46), when activated, prevents a return flow of the coolant from the inlet of the pump device (12) to the second coolant line (20) at all times but which is inactivated so as to be open when the engine is shut down, thereby providing for direct connection between the second cooling line (20) and the inlet of the pump device (12).

2. The cooling circuit as claimed in claim 1, wherein the valve device (46) in the switching valve bypass line (44) is operative to close said direct connection when the differential pressure across the valve device (24) exceeds a predetermined threshold value.

3. The cooling circuit as claimed in claim 2, wherein the predetermined threshold value is selected to be in a range between 0.1 bar and 0.3 bar.

4. The cooling circuit as claimed in claim 1, wherein the switching valve (24) is a thermostatic valve.

* * * * *